US005442158A

United States Patent [19]

Sawyer

[11] Patent Number: 5,442,158

[45] Date of Patent: Aug. 15, 1995

[54] HEATING ELEMENT SUPPORT CLIP

[75] Inventor: William C. Sawyer, Salida, Calif.

[73] Assignee: United States Department of Energy, Washington, D.C.

[21] Appl. No.: 156,753

[22] Filed: Nov. 24, 1993

[51] Int. Cl.[6] ..... H05B 3/26; H05B 3/66

[52] U.S. Cl. ..... 219/542; 219/536; 373/119; 373/128; 373/130

[58] Field of Search ..... 373/128, 129, 130, 119; 219/542, 532, 536; 338/290, 304, 305, 318; 392/432, 433, 434, 435, 436; 174/48, 138 J, 148, 158 R; 248/279, 282, 284, 288

[56] References Cited

U.S. PATENT DOCUMENTS

| | | | |
|---|---|---|---|
| 2,482,445 | 9/1949 | Turner | 373/130 |
| 2,744,946 | 5/1956 | Lewicki | 373/130 |
| 3,920,887 | 11/1975 | Klous et al. | 174/148 |
| 3,944,178 | 3/1976 | Greenwood | 248/288 |
| 3,963,859 | 6/1976 | Petersen et al. | 174/148 |
| 4,450,343 | 5/1984 | Dundon | 174/138 J |
| 5,170,975 | 12/1992 | Chadwick | 248/284 |
| 5,242,238 | 9/1993 | Warner et al. | 248/282 |
| 5,247,759 | 9/1993 | Noriega | 248/279 |

FOREIGN PATENT DOCUMENTS

| | | | |
|---|---|---|---|
| 881976 | 7/1953 | Germany | 373/130 |

*Primary Examiner*—Geoffrey S. Evans

*Attorney, Agent, or Firm*—Miguel Valdes; Roger S. Gaither; William R. Moser

[57] ABSTRACT

An apparatus for supporting a heating element in a channel formed in a heater base is disclosed. A preferred embodiment includes a substantially U-shaped tantalum member. The U-shape is characterized by two substantially parallel portions of tantalum that each have an end connected to opposite ends of a base portion of tantalum. The parallel portions are each substantially perpendicular to the base portion and spaced apart a distance not larger than a width of the channel and not smaller than a width of a graphite heating element. The parallel portions each have a hole therein, and the centers of the holes define an axis that is substantially parallel to the base portion. An aluminum oxide ceramic retaining pin extends through the holes in the parallel portions and into a hole in a wall of the channel to retain the U-shaped member in the channel and to support the graphite heating element. The graphite heating element is confined by the parallel portions of tantalum, the base portion of tantalum, and the retaining pin. A tantalum tube surrounds the retaining pin between the parallel portions of tantalum.

16 Claims, 3 Drawing Sheets

HEATING ELEMENT SUPPORT CLIP

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to heaters and heating elements, and more particularly, to an apparatus for supporting and for preventing a graphite heating element from contacting a ceramic base in which the heating element is mounted.

2. Description of the Related Art

Laser methods are sometimes used to separate isotopes for the enrichment of uranium. One such laser method is the Atomic Vapor Laser Isotope Separation (AVLIS) process. In the AVLIS process, the uranium is held in a vapor filled extractor having graphite walls. The graphite walls of the extractor must be heated in order to maintain the vapor within the extractor. The heating is accomplished by placing heaters along the exterior walls of the extractor. The extractor, along with the heaters attached thereto, is placed in a vacuum chamber.

Prior art extractor heaters typically include a ceramic base having a channel formed therein with a high temperature molly spring-like heating filament running through the channel. The heating filament is held in place with a ceramic grout. An electric current is drawn through the molly heating filament which causes it to become hot. The heat from the filament is transferred to the ceramic base which heats the extractor walls. This type of heater is capable of operating at approximately 5 watts per square centimeter. However, in order to achieve the 1000° C.+temperatures that are required in an extractor in the AVLIS process, the heaters must be operated continuously at their maximum output for long periods of time. Such intense use tends to cause the molly filament to burn-up relatively quickly.

Graphite-graphite composites have previously been used as heating elements for heaters. Graphite heating elements are capable of withstanding higher temperatures for longer periods of time than high temperature molly filaments. The higher heat capacity of graphite heating elements makes them ideal for replacing the molly filaments in heaters used to heat extractors in the AVLIS process. However, when a graphite heating element is used in a ceramic base, a chemical reaction occurs between the graphite and the ceramic at temperatures above 1000° C. The chemical reaction compromises the electrical isolation and the mechanical stability of the graphite heating element and until now has prevented graphite heating elements from being used with ceramic bases.

Thus, because ceramic is an ideal material to use for heater bases, and graphite is an ideal material to use for heating elements, there is a need for an apparatus that will prevent chemical reactions from occurring when graphite heating elements are used with ceramic bases.

SUMMARY OF THE INVENTION

The present invention provides a heating element support clip for supporting a heating element in a channel in a heater base. The support clip includes a substantially U-shaped member characterized by a horizontal surface with vertical projections at each end. A retainer retains the U-shaped member in the channel in the heater base. Each vertical projection is capable of accepting the retaining means and confining a heating element between the horizontal surface, the vertical projections, and the retainer.

In another embodiment, the present invention provides an apparatus for preventing a heating element from contacting a heater base. A substantially U-shaped member surrounds the heating element. The U-shaped member is formed from a material which will not react with the heater base or the heating element. The U shape is characterized by two substantially parallel portions each having an end connected to opposite ends of a base portion. The parallel portions are each substantially perpendicular to the base portion and spaced apart a distance not larger than a width of a channel formed in the heater base and not smaller than a width of the heating element. The parallel portions each have a hole therein, and the centers of the holes define an axis that is substantially parallel to the base portion. A retaining member extends through the holes in the parallel portions of the U-shaped member and into a hole in a wall of the channel formed in the heater base to retain the U-shaped member in the channel and to support the heating element. The heating element is confined by the parallel and base portions of the U-shaped member and the retaining member.

In another embodiment, the present invention provides a heater that includes a heater base member having a channel formed therein. An elongate heating element has a width not larger than a width of the channel. A substantially U-shaped member is formed from a material which will not react with the base member or the heating element for surrounding and supporting the heating element in the channel. The U shape is characterized by two substantially parallel portions that each have an end connected to opposite ends of a base portion. The parallel portions are each substantially perpendicular to the base portion and spaced apart a distance not larger than the width of the channel and not smaller than the width of the heating element. The parallel portions each have a hole therein, and the centers of the holes define an axis that is substantially parallel to the base portion. A retaining member extends through the holes in the parallel portions of the U-shaped member and into a hole in a wall of the channel to retain the U-shaped member in the channel and to support the heating element. The heating element is confined by the parallel and base portions of the U-shaped member and the retaining member.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE PREFERRED EMBODIMENTS

Figure 1:
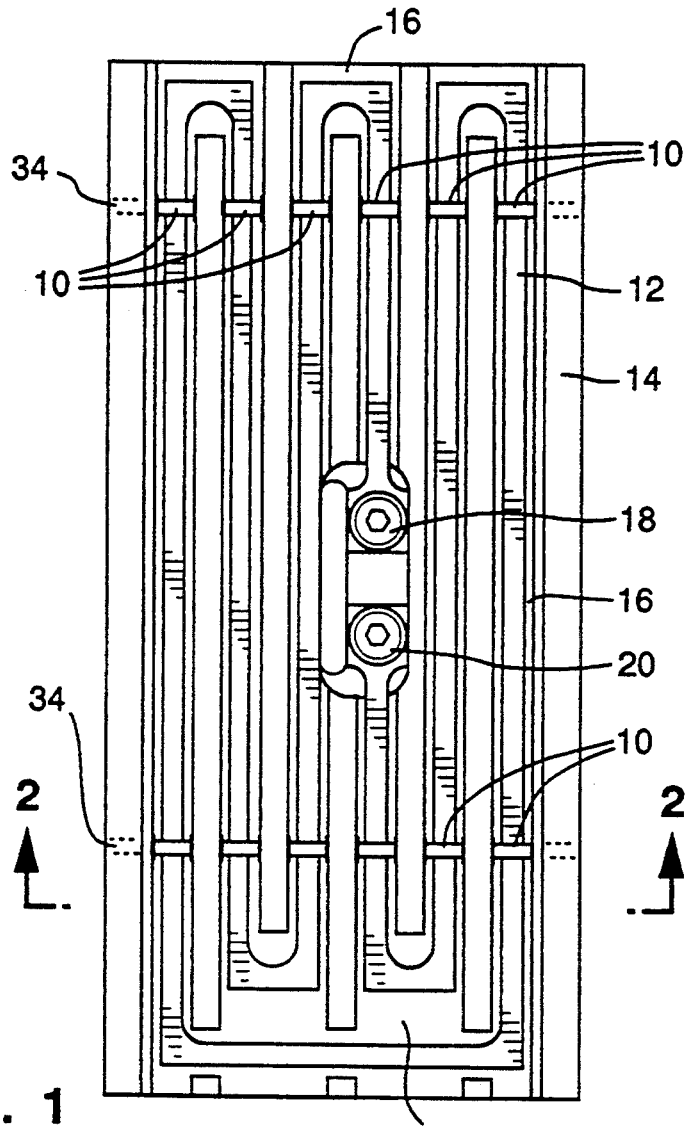
FIG. 1 is a top plan view illustrating a heating element being supported in a heater base by several heating element support clips in accordance with the present invention.

Referring to FIG. 1, there is illustrated several heating element support clips 10 in accordance with the present invention. The clips 10 support and prevent a thin graphite-graphite composite heating element 12 from contacting a ceramic heater base 14. The graphite heating element 12 is formed from a single piece of graphite which weaves back and forth through a channel 16. The channel 16 is formed in the ceramic base 14. The ceramic base 14 is preferably an aluminum oxide ($Al_2O_3$) ceramic base.

The clips 10 support the graphite heating element 12 at several locations. The ends of the graphite heating element 12 are electrically connected to terminals 18 and 20 which provide electricity to heat the graphite heating element 12. The graphite heating element 12 can produce approximately 15 watts per square centimeter which produces the extra heat required to heat an extractor in the AVLIS process. In addition, the graphite heating element 12 has an extremely low failure rate because of its ability to withstand high temperatures. Because the graphite heating element 12 is prevented from contacting the ceramic base 14, chemical reactions between the graphite composite and the aluminum oxide do not occur which would otherwise occur at approximately 1300° C. Furthermore, the ceramic base 14 provides electrical isolation between the graphite heating element 12 and ground.

Figure 2:
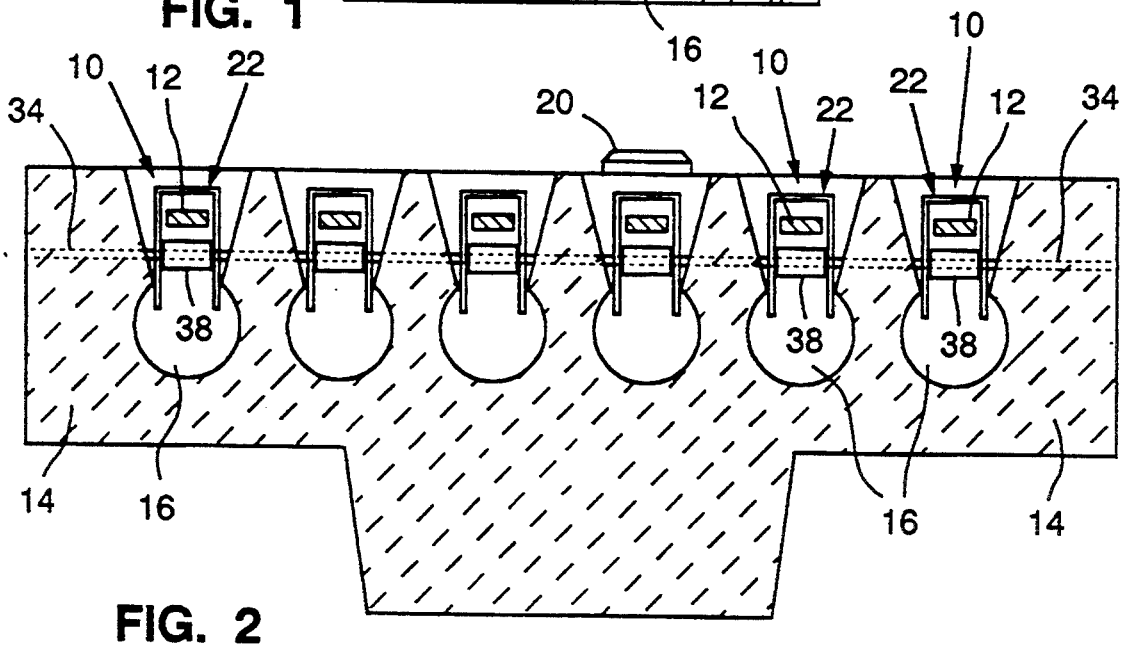
FIG. 2 is a cross-sectional view taken along line 2—2 of FIG. 1 illustrating channels formed in the heater base.
Figure 3:
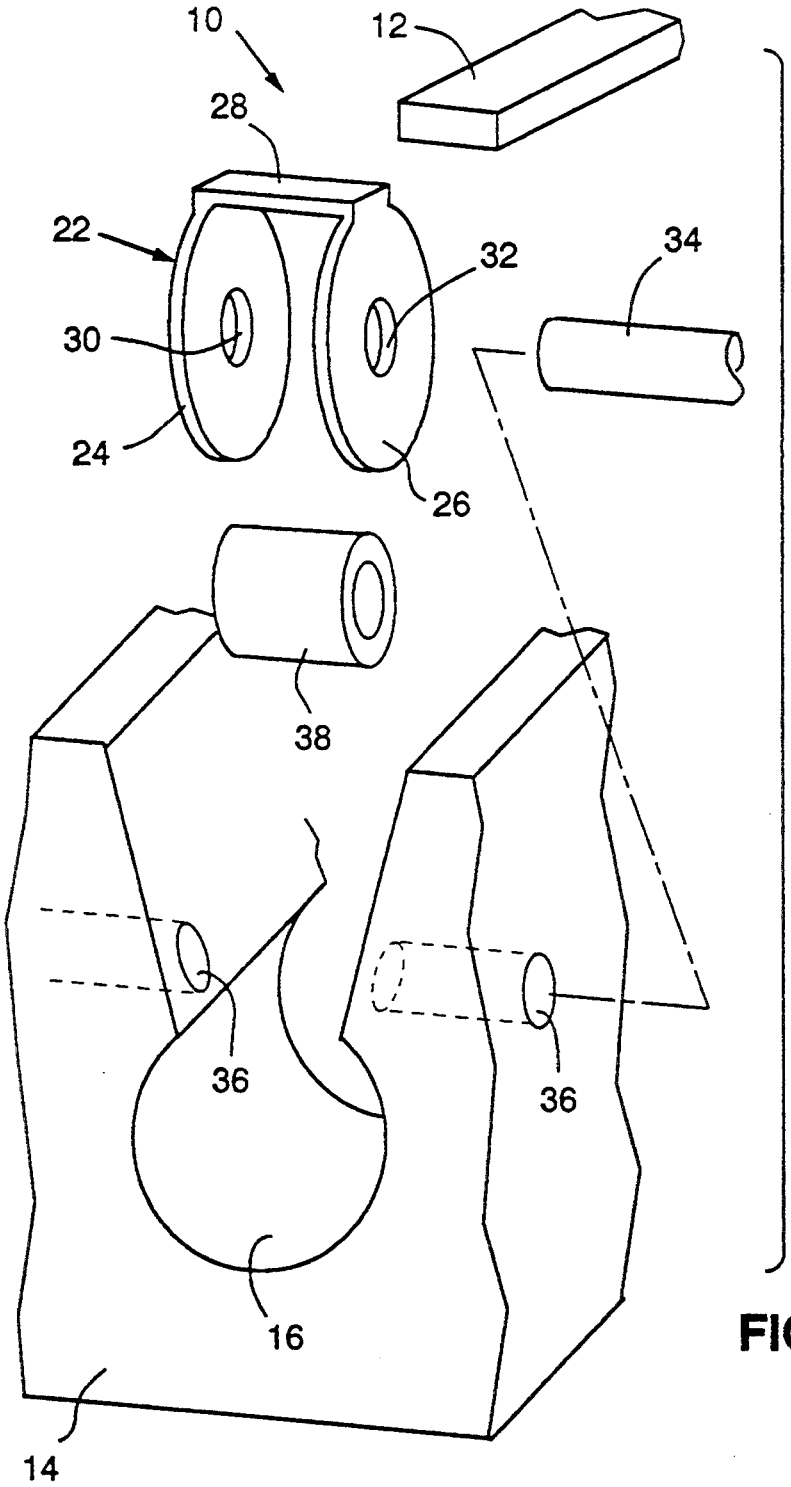
FIG. 3 is an enlarged, exploded view of one of the heating element support clips shown in FIG. 1.

FIGS. 2 and 3 illustrate the detailed structure of the clips 10. Each of the clips 10 includes a substantially U-shaped member 22 for surrounding the heating element 12. The U-shaped member 22 is formed from a material which will not react with the heating element 12 or the heater base 14. When the heating element 12 is formed from a graphite-graphite composite, and the heater base 14 is formed from aluminum oxide ceramic, the U-shaped member 22 is preferably formed from tantalum. Tantalum will not react with the graphite heating element 12 or the ceramic base 14 at the approximately 1300° C. temperatures required to heat an extractor in the AVLIS process.

The U shape of the U-shaped member 22 is characterized by two substantially parallel portions, or vertical projections, of tantalum 24 and 26 that each have an end connected to opposite ends of a base portion, or a horizontal surface, of tantalum 28. The parallel portions 24 and 26 are each substantially perpendicular to the base portion 28 and are preferably circular in shape. Furthermore, the parallel portions 24 and 26 should be spaced apart a distance large enough to allow the graphite heating element 12 to fit between the parallel portions 24 and 26 and small enough to allow the U-shaped member 22 to fit into the channel 16. In other words, the parallel portions 24 and 26 should be spaced apart a distance not larger than the width of the channel 16 and not smaller than the width of the graphite heating element 12.

The parallel portions 24 and 26 each have a hole 30 and 32, respectively, therein. The holes 30 and 32 are preferably aligned such that their centers define an axis that is substantially parallel to the base portion 28. The holes 30 and 32 provide a means for receiving a retaining pin 34 for retaining the U-shaped member 22 in the channel 16. The ceramic base 14 has a hole 36 drilled near each end to receive the retaining pins 34. The retaining pins 34 are inserted through each hole 36 in the ceramic base 14. Each retaining pin 34 supports six of the U-shaped members 22.

The retaining pin 34 extends through the holes 30 and 32 and into the hole 36 in the walls of the channel 16. The retaining pin 34 suspends and retains the U-shaped member 22 in the channel 16 which supports the graphite heating element 12. The graphite heating element 12 is confined by the parallel portions 24 and 26, the base portion 28, and the retaining pin 34. The retaining pin 34 preferably has a diameter of 1/16" and is made of the same material as the heater base 14, i.e., aluminum oxide ceramic. Furthermore, the retaining pin 34 is removable so that the U-shaped member 22 may be removed.

A tube 38 surrounds the retaining pin 34 between the parallel portions 24 and 26 of each U-shaped member 22 to insulate the retaining pin 34 from the graphite heating element 12. The tube 38 preferably has an outside diameter of $\frac{1}{8}$" and is made of the same material as the U-shaped member, i.e, tantalum.

Figure 4:
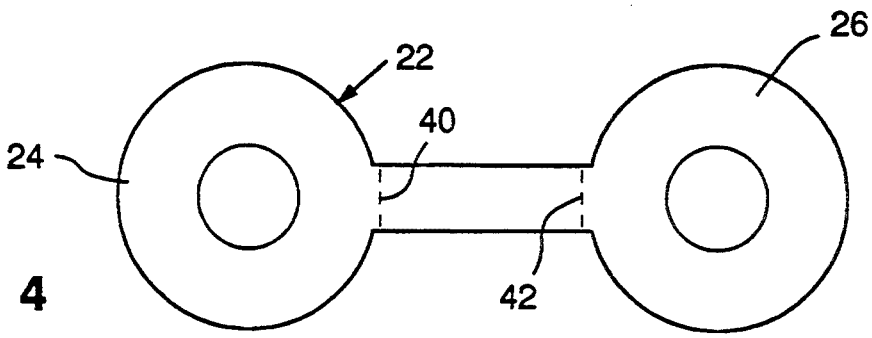
FIG. 4 is a top plan view of the U-shaped member shown in FIG. 3 before it is bent into the U shape.

Referring to FIG. 4, the U-shaped member 22 is formed from a single, flat piece of tantalum. The U-shaped member 22 is bent along lines 40 and 42 to form the U shape.

Figure 5:
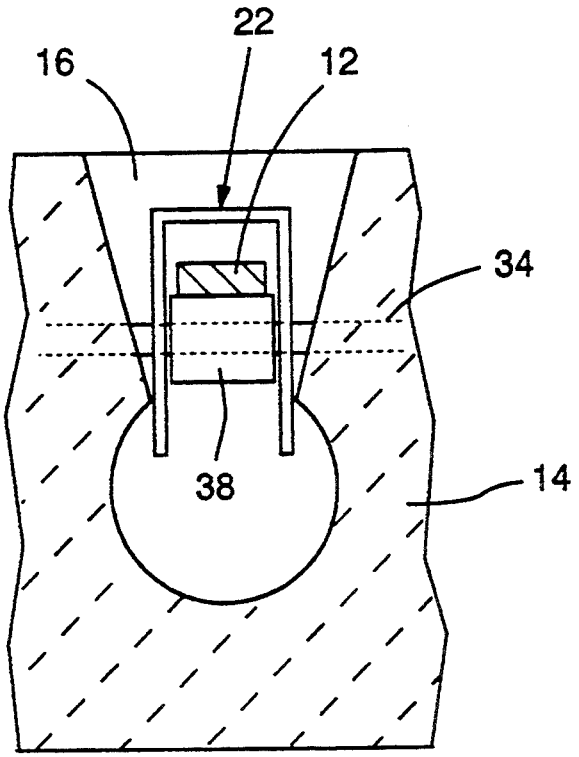
FIG. 5 is a partial cross-sectional view of a heater base illustrating one way that a heating element support clip may be positioned in a channel.
Figure 6:
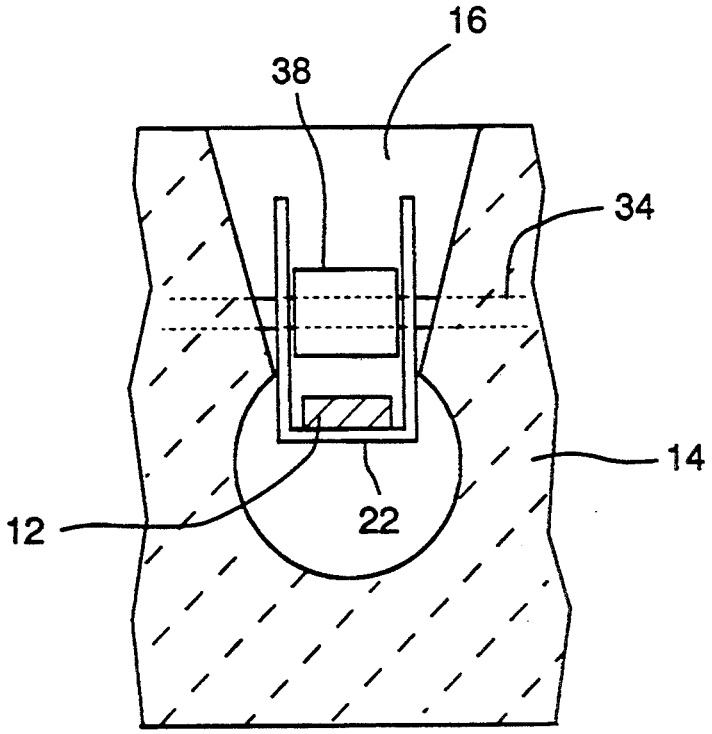
FIG. 6 is a partial cross-sectional view of a heater base illustrating another way that a heating element support clip may be positioned in a channel.

FIGS. 5 and 6 illustrate two alternate ways in which the U-shaped member 22 may be positioned in the channel 16 of the ceramic base 14. FIG. 5 shows the opening of the U shape facing down into the channel 16. In this scenario the graphite heating element 12 is positioned closer to the top of the channel 16. FIG. 6 shows the opening of the U shape facing up in the channel 16. In this scenario the graphite heating element is positioned in the lower part of the channel 16.

It should be understood that various alternatives to the embodiments of the invention described herein may be employed in practicing the invention. It is intended that the following claims define the scope of the invention and that structures and methods within the scope of these claims and their equivalents be covered thereby.

What is claimed is:

1. A heating element support clip for supporting a heating element in a channel in a heater base, comprising:

a substantially U-shaped member characterized by two substantially parallel portions each having an end connected to opposite ends of a base portion, the parallel portions each having a hole therethrough and being substantially perpendicular to the base portion;

a retaining pin extending through the holes in the parallel portions for retaining the U-shaped member in a channel in a heater base; and wherein, the holes in the parallel portions are positioned so that a heating element may be confined between the base portion, the parallel portions, and the retaining pin.

2. A heating element support clip for supporting a heating element in a channel in a heater base, comprising:

a substantially U-shaped member characterized by two substantially parallel portions each having an end connected to opposite ends of a base portion, the parallel portions each being substantially perpendicular to the base portion;

retaining means for retaining the U-shaped member in a channel in a heater base;

wherein, each parallel portion has means for accepting the retaining means and for confining a heating element between the base portion, the parallel portions, and the retaining means; and wherein the retaining means includes:

a retaining pin that extends through a hole formed in each of the parallel portions; and a tube surrounding the retaining pin between the parallel portions, the tube being formed from the same material as the U-shaped member.

3. A heating element support clip according to claim 2, wherein:

the retaining pin is formed from ceramic; and the U-shaped member and the tube are formed from tantalum.

4. An apparatus for preventing a heating element from contacting a heater base, comprising:

a substantially U-shaped member for surrounding a heating element, the U-shaped member being formed from a material which will not react with a heater base or the heating element, the U shape being characterized by two substantially parallel portions each having an end connected to opposite ends of a base portion, the parallel portions each being substantially perpendicular to the base portion and spaced apart a distance not larger than a width of a channel formed in the heater base and not smaller than a width of the heating element, the parallel portions each having a hole therein, the holes having centers defining an axis that is substantially parallel to the base portion; and a retaining member extending through the holes in the parallel portions of the U-shaped member and into a hole in a wall of the channel formed in the heater base to retain the U-shaped member in the channel and to support the heating element, the heating element being confined by the parallel and base portions of the U-shaped member and the retaining member.

5. An apparatus according to claim 4, wherein the retaining member comprises:

a retaining pin; and a tube surrounding the retaining pin between the parallel portions of the U-shaped member, the tube being formed from the same material as the U-shaped member.

6. An apparatus according to claim 5, wherein the U-shaped member and the tube are formed from tantalum.

7. An apparatus according to claim 5, wherein the retaining pin is formed from ceramic.

8. A heater, comprising:

a heater base member having a channel formed therein;

an elongate heating element having a width not larger than a width of the channel;

a substantially U-shaped member formed from a material which will not react with the base member or the heating element for surrounding and supporting the heating element in the channel, the U shape being characterized by two substantially parallel portions each having an end connected to opposite ends of a base portion, the parallel portions each being substantially perpendicular to the base portion and spaced apart a distance not larger than the width of the channel and not smaller than the width of the heating element, the parallel portions each having a hole therein, the holes having centers defining an axis that is substantially parallel to the base portion; and a retaining member extending through the holes in the parallel portions of the U-shaped member and into a hole in a wall of the channel to retain the U-shaped member in the channel and to support the heating element, the heating element being confined by the parallel and base portions of the U-shaped member and the retaining member.

9. An apparatus according to claim 8, wherein the retaining member comprises:

a retaining pin; and a tube surrounding the retaining pin between the parallel portions of the U-shaped member, the tube being formed from the same material as the U-shaped member.

10. An apparatus according to claim 9, wherein:

the retaining pin and heater base member are formed from ceramic;

the heating element is formed from a graphite-graphite composite; and the U-shaped member and the tube are formed from tantalum.

11. An apparatus according to claim 10, wherein the ceramic comprises aluminum oxide.

12. An apparatus for supporting a graphite-graphite composite heating element in a channel formed in an aluminum oxide ceramic base, comprising:

a substantially U-shaped tantalum member, the U-shape being characterized by two substantially parallel portions of tantalum each having an end connected to opposite ends of a base portion of tantalum, the parallel portions each being substantially perpendicular to the base portion and spaced apart a distance not larger than a width of the channel and not smaller than a width of the graphite heating element, the parallel portions each having a hole therein, the holes having centers defining an axis that is substantially parallel to the base portion;

an aluminum oxide ceramic retaining pin extending through the holes in the parallel portions and into a hole in a wall of the channel to retain the U-shaped member in the channel and to support the graphite heating element, the graphite heating element being confined by the parallel portions of tantalum, the base portion of tantalum, and the retaining pin; and a tantalum tube surrounding the retaining pin between the parallel portions of tantalum.

13. An apparatus according to claim 12, wherein the parallel portions of tantalum are substantially circular in shape.

14. An apparatus according to claim 12, wherein the parallel portions of tantalum and the base portion of tantalum comprise a single piece of tantalum that is bent to form the U-shaped member.

15. An apparatus according to claim 12, wherein the retaining pin has a diameter approximately equal to one-sixteenth of an inch.

16. An apparatus according to claim 12, wherein the tantalum tube has an outside diameter approximately equal to one-eighth of an inch.

* * * * *